US010641441B2

(12) United States Patent
Wolfenden, Jr. et al.

(10) Patent No.: US 10,641,441 B2
(45) Date of Patent: May 5, 2020

(54) LUMINAIRE SYSTEM WITH LIGHT DISTRIBUTION MODIFIER

(71) Applicant: FARLIGHT LLC, Wilmington, CA (US)

(72) Inventors: Robert Wolfenden, Jr., Rolling Hills Estate, CA (US); David Glover, Agua Dulce, CA (US); Robert Burger, Newton, MA (US); Steve Becerra, San Pedro, CA (US); Robert Wolfenden, Sr., Stevensville, MT (US)

(73) Assignee: FARLIGHT, LLC

( * ) Notice: Subject to any disclaimer, the term of this patent is extended or adjusted under 35 U.S.C. 154(b) by 0 days.

(21) Appl. No.: 16/246,476

(22) Filed: Jan. 12, 2019

(65) Prior Publication Data

US 2019/0390825 A1 Dec. 26, 2019

Related U.S. Application Data

(63) Continuation of application No. 15/600,663, filed on May 19, 2017, now Pat. No. 10,180,215.

(51) Int. Cl.

| | |
|---|---|
| ***F21V 7/04*** | (2006.01) |
| ***F21K 9/68*** | (2016.01) |
| ***F21V 19/00*** | (2006.01) |
| ***F21V 29/70*** | (2015.01) |
| ***F21V 5/00*** | (2018.01) |
| *F21Y 113/13* | (2016.01) |
| *F21Y 115/10* | (2016.01) |

(52) U.S. Cl.

CPC ..... *F21K 9/68* (2016.08); *F21V 5/005* (2013.01); *F21V 7/04* (2013.01); *F21V 19/0015* (2013.01); *F21V 29/70* (2015.01); *F21Y 2113/13* (2016.08); *F21Y 2115/10* (2016.08)

(58) Field of Classification Search

CPC ..... F21K 9/65; F21K 9/66; F21K 9/68; F21K 9/69; F21S 41/25; F21V 19/003; F21V 19/005; F21V 19/0055; F21V 5/08; F21V 7/06; F21V 7/08; F21V 7/09

USPC ..... 362/303

See application file for complete search history.

(56) References Cited

U.S. PATENT DOCUMENTS

2010/0091507 A1* 4/2010 Li ..... F21V 7/09 362/470

* cited by examiner

*Primary Examiner* — Evan P Dzierzynski
*Assistant Examiner* — Keith G. Delahoussaye
(74) *Attorney, Agent, or Firm* — Clay McGurk; The Law Office of Clay McGurk

(57) ABSTRACT

A luminaire system is provided that has directional light projection optics combined with a light distribution modifier to produce a non-uniform angular light intensity distribution from a single or array of light sources. The luminaire system provides for light intensity distribution with directional asymmetry meeting the specifications and requirements of aviation obstruction lights. The light distribution modifier component or subassembly redirects, scatters, refracts, diffracts and/or blocks part of the projection light in the distribution of the primary optics that would otherwise produce ground scatter. Unlike peripheral light shields at the marginal limits of the light distribution from the luminaire light system, the light distribution modifier is located near to the optical axis of the projection optics system.

19 Claims, 5 Drawing Sheets

LUMINAIRE SYSTEM WITH LIGHT DISTRIBUTION MODIFIER

RELATED APPLICATIONS

This application is a continuation of U.S. patent application Ser. No. 15/600,663 filed May 19, 2017, now patented as U.S. Pat. No. 10,180,215, which is incorporated by reference in its entirety herein.

TECHNICAL FIELD

This invention relates to a luminaire system that meets the requirements of aviation obstruction lights and aviation airfield and heliport lights that require asymmetrical beam distribution patterns where the light intensity distribution about the optomechanical axis is biased such that the amount and intensity of light on one side of the optical axis is substantially greater than that on the other side. In addition, a luminaire system that meets the requirements of commercial and industrial area lights that require asymmetrical beam distribution patterns where the light intensity distribution about the optomechanical axis is biased such that the amount of light on one side of the optical axis is substantially greater than that on the other side.

BACKGROUND OF THE INVENTION

Aviation lights for air fields, landing zones and obstructions or hazards to flight safety must meet detailed requirements for directional field of illumination, intensity distribution, color, duty cycle, pulse repetition rate, control, electrical, mechanical and environmental performance and durability. The United States Federal Aviation Administration (FAA) and international regulatory bodies govern the regulations, test and certification procedures for photometric, systems performance and durability.

The photometric requirements of lights and luminaire assemblies for specific purposes of aviation navigation, landing, take-off and flight control have detailed specifications for the distribution of light intensity dependent upon the placement and application. In order to meet the specifications for each type of luminaire, manufacturers typically use external optics to modify the illumination pattern from the light source (single or array of thermal, arc, or solid state devices) peculiar to the application. Conventional aviation obstruction lights employ lenses and/or mirrors with light sources to produce directional illumination patterns and intensity distributions for navigation aid to pilots and avionics systems within a design field of view for specific flight operation scenarios. The specifications for aviation obstruction lights on buildings, towers and other structures located away from air fields and landing zones include both requirements for intensity distribution in the field of view of the pilot and avionics, and restrictions on environmental light pollution or ground scatter sometimes referred to as residential annoyance factor. Conventional methods of optical systems design for mitigating ground scatter include off-axis optical elements, optics that tilt the optical axis, and baffles to vignette extraneous light illumination from the lower edges of the field of illumination incident on the ground and surrounding residential and commercial areas (e.g., Dialight and Hughley & Phillips).

SUMMARY OF THE INVENTION

The present invention is a luminaire system with directional light projection optics combined with a light distribution modifier secondary to the primary optics. The projection optics plus light distribution modifier produces a non-uniform angular light intensity distribution from a single or array of light sources. The combination of primary optics and light distribution modifier provides for light intensity distribution with directional asymmetry meeting the specifications and requirements of aviation obstruction lights in an efficient, cost-effective, manufacturable manner. The specific purpose of the light distribution modifier component or subassembly of the optical system is to redirect, scatter, refract, diffract and/or block part of the projection light in the distribution of the primary optics that would otherwise produce environmental light pollution, light producing residential annoyance, or in the case of commercial or industrial lights, extraneous glare and other light pollution to the surrounding environment. Unlike peripheral light shields at the marginal limits of the light distribution from the luminaire light system, the light distribution modifier is located near to the optical axis of the projection optics system.

In one embodiment, the light system subassembly of the luminaire comprises a heat-sink hub with printed circuit boards (PCB) mounted on the perimeter in sectors. Each PCB has an array of HBLED (High Brightness Light-Emitting Diode) light source elements of select colors (e.g., white, red and infrared). Primary reflector optic modules are mounted to the PCB with the HBLEDs. The reflectors have an upper and lower on and/or off-axis aspheric segments joined by a connecting base between the two reflector surfaces. The base has apertures for the illumination sources and registration hardware to locate and mount the reflector modules to the hub of the luminaire.

A light distribution modifier in the form of optically black shield is mounted to the hub-PCB assembly between the upper and lower reflector surfaces of each subassembly module. The upper and lower reflectors collect and redirect high angle light irradiation from the HBLEDs out the open aperture on either side of the light distribution modifier with a narrow beam spread of light in a distribution that has a peak at a positive angle (typically, 1 to 2 degrees) above the horizontal optical axis. Direct LED radiation projects upward missing the reflectors in a narrow solid angle through a narrow aperture in the light distribution modifier close to the optical axis or is blocked by the light distribution modifier.

The light distribution modifier biases the overall light intensity distribution in the positive vertical direction above the optical axis and blocks the light that would project below the optical axis (horizontal) resulting in an asymmetric light intensity distribution in the positive vertical direction with sharp cut-off in intensity below the horizontal (where the horizontal is collocated with the optomechanical axis at zero degrees vertical). The luminaire optical assembly is completed with a transparent window for environmental protection of the hub and mounted optics (primary reflectors and secondary light distribution modifiers). The overall light distribution from the luminaire meets the photometric light distribution requirements for aviation obstruction lights including medium intensity white daylight with peak intensity at or above the horizontal, intensity between 15,000 and 25,000 candelas at the horizontal (zero degree vertical), intensity between 7,500 and 11,250 candelas at −1 degree vertical, ground scatter intensity less than 3 percent of the peak intensity at −10 degree vertical, and beam spread of greater than 3 degrees.

In one embodiment, a luminaire system comprises at least one light source, a reflector module, and a light distribution modifier, connectable to the reflector module, that produces a structured "elliptical" light distribution with peak intensity above an optical axis and a sharp cut off in intensity below the optical axis.

In another embodiment, a luminaire light system comprises at least one printed circuit board, at least one light source mounted to the at least one printed circuit board, a reflector module connected around the at least one light source, and a light distribution modifier having an upper portion connected to the reflector module and a lower portion connected to the reflector module, the upper portion is separated from the lower portion by a distance, the light distribution modifier producing a light distribution with peak intensity above an optical axis and a sharp cut off in intensity below the optical axis.

In another embodiment, a luminaire system comprises an array of light emitting diodes (LED) modules, a reflector module surrounding the array of LED modules, and a light distribution module having a slit aperture positioned along an optical axis, the light distribution module comprising an upper portion and a lower portion, wherein each the upper portion and the lower portion where at least a first part extends a distance from the reflector module and a second part is positioned in a direction perpendicular to the optical axis.

In another embodiment, a luminaire system comprises arrays of light emitting diodes on PC boards, reflector modules surrounding each array of LED modules, and a light distribution modifier module spaced in the field of the LED modules and reflector optics populating all sectors of the hub assembly to produce an omni-directional luminaire of uniform intensity distribution over 360 degree horizontal and defined asymmetrical vertical distribution meeting the specifications for peak intensity, intensity at zero degrees vertical, beam spread, intensity at −1 degree vertical and intensity at −10 degrees vertical.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Figure 1:
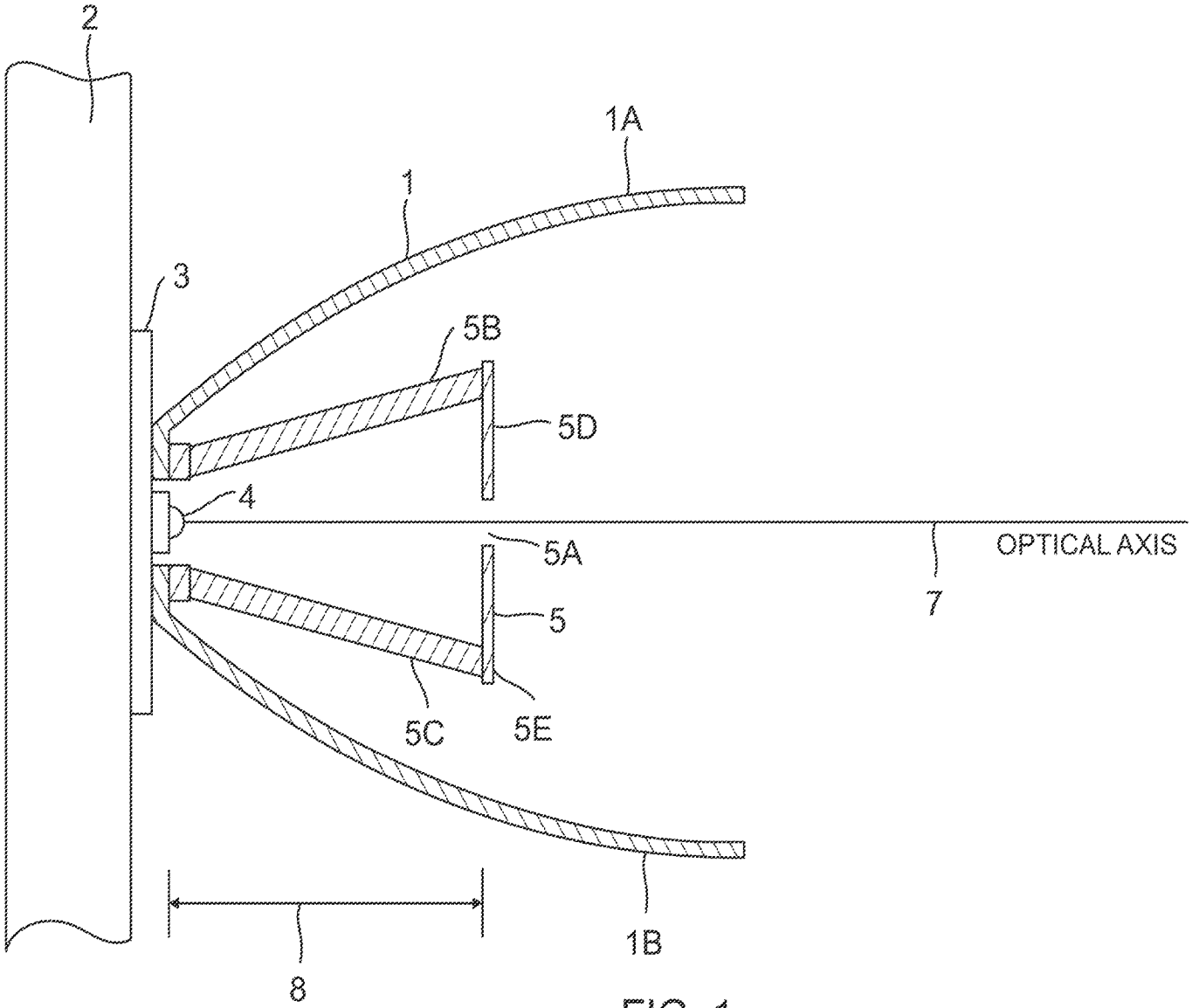
FIG. 1 illustrates in one embodiment of the present invention a 2-dimensional cut-away of FarLight's optical system with reflector subassembly mounted to a hub with LED light sources mounted to a printed circuit board (PCB) that emit through apertures in the reflector base plus a light distribution modifier (i.e., black shield) also mounted to the reflector subassembly and PCB on the hub.

FIG. 1 is a side view cut-away cross-section of a single reflector module with light distribution modifier mounted to the hub of a luminaire light system according to an embodiment of the present invention. The mechanical hub 2 provides the mechanical base, support and heat sink for LED (light emitting diode) light sources, driver electronics, and circuitry on PCB (printed circuit board) 3. LED light source 4 is mounted to a surface on PCB 3.

Reflector module 1 is mounted to the PCB 3 and hub 2 by mechanical fixation known to those skilled in the art. Reflector module 1 has an upper reflector surface 1A, and a lower reflector surface 1B. These reflector surfaces 1A, 1B reflect light from the LED 4. The reflector surfaces 1A, 1B can be curved as shown in FIG. 1, or in any other shape such as straight for example. The inside of reflector surfaces 1A and 1B (the side facing the LED light sources) can be a mirror or coated with any other type of reflective surface known to those skilled in the art. In an alternative embodiment, the reflector module comprises an upper on-axis aspheric mirror and a lower off-axis tilted aspheric mirror.

Light distribution modifier 5 is mechanically fixed and registered to the reflector module 1, PCB 3 and hub 2. Light distribution modifier 5 has a clear aperture or slit 5A normal to the direction of illumination of the LED light source on optical axis 7. Light distribution modifier 5 is located a distance 8 from the LEDs in the far field from the LEDs, for example about 10 mm distance.

In an alternative embodiment, the light distribution modifier is opaque and effectively blocks part of the light pattern of radiation form the light source.

In a further alternative embodiment, the light distribution modifier is opaque and effectively blocks part of the light pattern of radiation from the light source but the lower surface of the light distribution modifier is reflective thereby reflecting and redirecting light from the light source incident on the lower surface to secondary reflection from the upper or lower reflector such that the light distribution intensity from the optic assembly is biased to positive vertical direction on the plus side of the optical axis.

In another alternative embodiment, the light distribution modifier incorporates a refractive optical element for example but not limited to a wedge prism, an array of microprisms, a positive or negative lens off-axis or tilted, microlens assembly or other refractive optic to refract light incident on the light distribution modifier in the positive vertical direction of the light distribution from the luminaire system.

In another alternative embodiment, the light distribution modifier incorporates a transmissive diffractive optical element for example but not limited to a transmission grating, or a Rhonchi ruling, binary optic, structured light modifier, light shaping diffuser, or other diffractive optic to diffract light incident on the light distribution modifier in the positive vertical direction of the light distribution from the luminaire system.

In another alternative embodiment, the light distribution modifier incorporates a mesoscopic array structure or a nanoscopic array structure or antenna array structure to redirect light incident on the light distribution modifier in the positive vertical direction of the light distribution of the luminaire system or toward the upper or lower reflector surface thereby contributing to the overall intensity distribution with bias in the positive vertical direction of the luminaire system by means of secondary reflection from the upper or lower reflector or redirection in the positive vertical direction without secondary reflection from the upper or lower reflector.

Light distribution modifier 5 has an upper portion and a lower portion. The upper portion of the light distribution modifier 5 has one or more arms 5B that extends as shown in FIG. 1 from the reflector module 1 or PCB 3 some distance from the LED light source. The lower portion of the light distribution module 5 also has one or more arms 5C that extends at an angle from the reflector module 1 or PCB 3 some distance from the LED light source. At one end of each of the arms 5B, 5C, a shield 5D, 5E having a length extends in a vertical direction which is perpendicular to the optical axis 7. A space or slit is formed by a distance between the shields 5D, 5E whereby LED module 5 emits light along the optical axis 7 through the space or slit formed between the upper portion and the lower portion of the light distribution modifier 5. To those skilled in the art, the upper portion and the lower portion of the light distribution modifier 5 can be formed, molded or created into one or more pieces. In an alternative embodiment, the light distribution modifier is formed by conventional molding process, machined or generated using a 30-dimensional printer by additive manufacturing.

In one embodiment, the LED light source can comprise an array of HBLED (High Brightness Light-Emitting Diode) light source elements of select colors (e.g., white, red and infrared). The LED light source can be one color or a mixture of visible colors, infrared, ultraviolet, or a mixture thereof of different wavelength LEDs.

Figure 2:
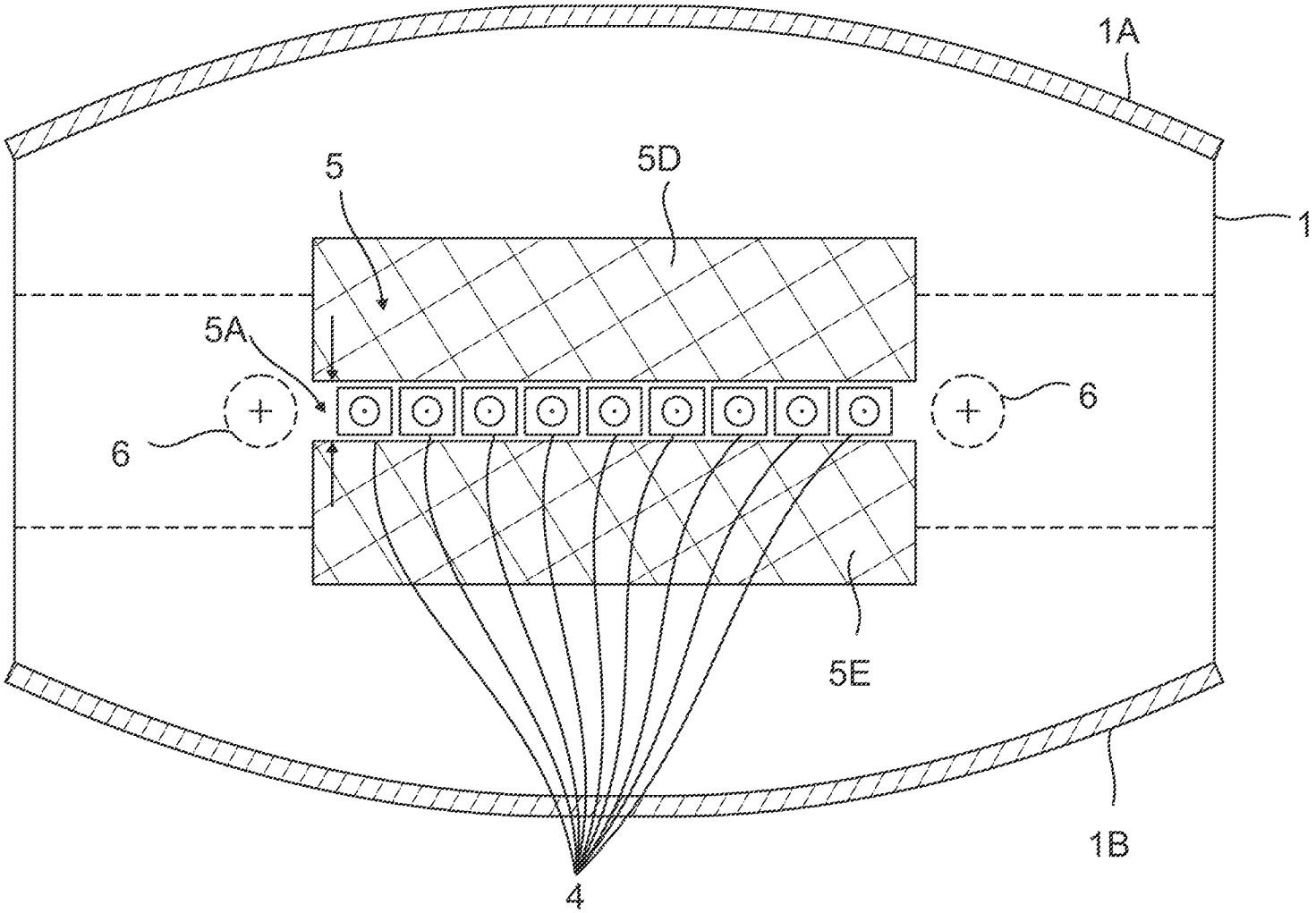
FIG. 2 is a top down front view of the subassembly in FIG. 1 further illustrating the mechanical arrangement of the components of the light subassembly according to an embodiment of the present invention.

FIG. 2 is a top down, front view of the subassembly in FIG. 1 further illustrating the mechanical arrangement of the components of the light module subassembly mounted to the hub according to an embodiment of the present invention. Reflector module 1 is mounted to the PCB and hub (see FIG. 1) by mechanical fixation 6 through holes for mounting screws. Other means can be used for mounting reflector module 1 to the PCB and hub as known to those skilled in the art. The lower surface of the reflector module 1 has registration tits for mating to locator holes in the PCB.

As illustrated in FIG. 2, reflector module 1 has an upper reflector surface 1A, and a lower reflector surface 1B, that both reflect light from an array of LEDs 4 out the open aperture 5A or between the upper portion 5D and the lower portion 5E of the light distribution modifier 5. The slit aperture 5A is formed between the upper portion 5D and a lower portion 5E of the light distribution modifier 5. As illustrated in FIG. 2, the upper portion 5D and the lower portion 5E are not equal in size, where the lower portion 5E can be larger in size than the upper portion 5D so that there is a sharp cut off in intensity below the optical axis. The upper portion 5D and the lower portion 5E may be equal or different sizes and may be longer what is illustrated in FIG. 2. The slit aperture 5A is normal to the direction of illumination of the LED light source and open apertures on either side between the modifier and reflector surfaces 1A and 1B.

In alternative embodiments, the light distribution modifier 5 may be one piece, where the upper portion 5D and the lower portion 5E join together with a clear aperture or lens between them so that light would be emitted therefrom along the optical axis. Moreover, in alternative embodiments, the arms 5B, 5C (FIG. 1) may or may not be used as shown in FIG. 1, and replaced by a single arm on each side of the one-piece light distribution modifier 5. Any light distribution modifier 5, whether in one or more parts or whether having different shapes or different sizes, can be used that meets the requirements as discussed herein.

Figure 3:
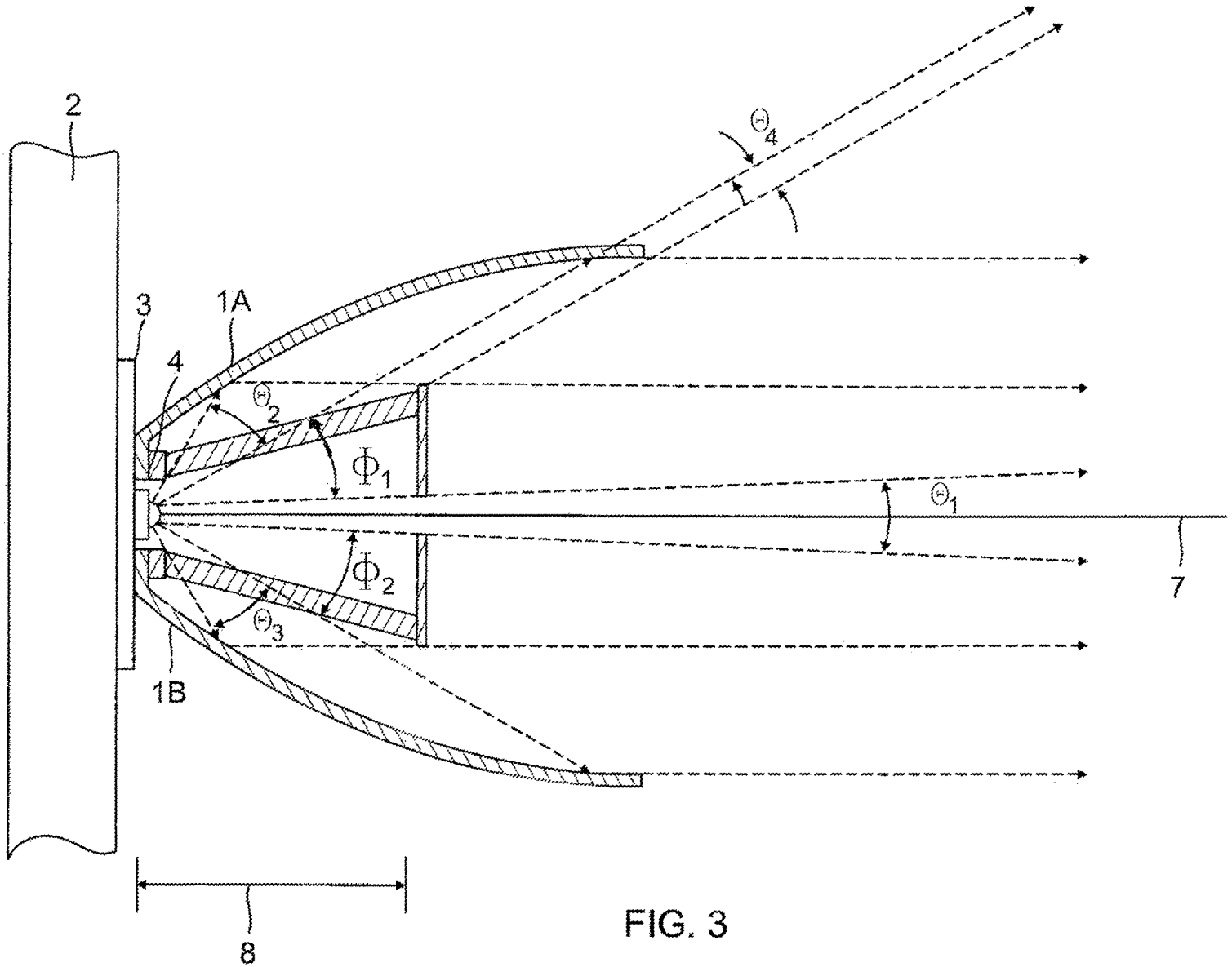
FIG. 3 is a cross-sectional view in FIG. 1 that illustrates the limiting light ray projections from the optical system to demonstrate the principle of operation of the light distribution modifier according to an embodiment of the present invention.

FIG. 3 is a cross-sectional view in FIG. 1 that illustrates the limiting light ray projections from the optical system demonstrating the principle of operation of the light distribution modifier according to an embodiment of the present invention. Light rays from the LED source 4 projecting over the angular field $\theta_1$, pass through the clear aperture or slit of light distribution modifier 5. The upper and lower limiting rays over the angular field $\theta_1$ diffract from the light distribution modifier 5 at high angles outside of the field of interest and specification for the aviation light assembly.

Light rays from the LED source 4 projecting over the angular field $\theta_2$ reflect from the upper reflector surface 1A in a direction approximately or substantially parallel to optical axis 7. Light rays from the LED source 4 projecting over the angular field $\theta_3$ reflect from the lower reflector surface 1B in an angular direction slightly positive to the optical axis 7.

Light rays from the LED source 4 projecting over the angular field $\theta_2$ that reflect from the upper reflector surface but are incident on the outer edge of light distribution modifier 5 distance 8 from the LEDs, diffract from the light distribution modifier 5 at high angles outside of the field of interest and specification for the aviation light assembly. Light rays from the LED source 4 projecting over the angular field $\theta_4$ that miss the upper reflector surface project in the positive vertical distribution of the aviation light assembly thereby increasing the beam spread of the luminaire for enhanced visibility to a pilot approaching the obstruction light.

Light rays from the LED source 4 projecting over the angular field $\theta_3$ that reflect from the lower reflector surface but are incident on the outer edge of light distribution modifier 5 distance 8 from the LEDs, also diffract from the light distribution modifier 5 at high angles outside of the field of interest and specification for the aviation light assembly.

Light rays from the LED source 4 projecting over the angular field $\theta_1$ that are incident on the upper back side of light distribution modifier 5 are blocked and do not contribute to the light distribution from the aviation light assembly in the far field. Light rays from the LED source 4 projecting over the angular field $\theta_2$ that are incident on the lower back side of light distribution modifier 5 are blocked and do not contribute to the light distribution from the aviation light assembly in the far field.

Figure 4:
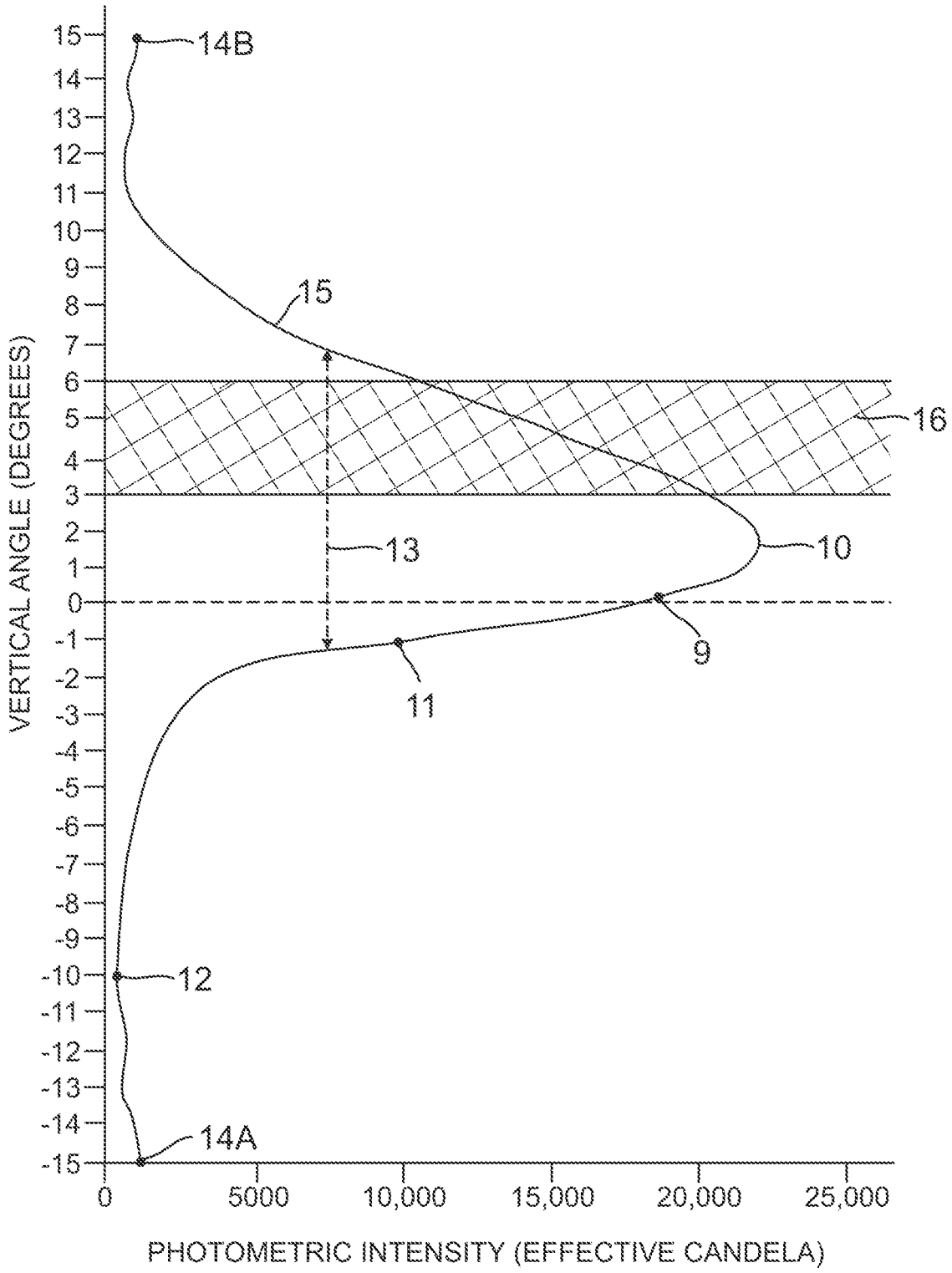
FIG. 4 is an illustration of a two-dimensional photometric intensity vertical light distribution pattern in the far field from the optical system in FIGS. 1-3.

FIG. 4 is an illustration of a 2-dimensional photometric intensity vertical light distribution pattern in the far field from the optical system in FIGS. 1, 2 and 3. The vertical axis on the left represents the angle in degrees for vertical light distribution from the aviation obstruction light assembly in FIGS. 1, 2, and 3. The aviation horizon or horizontal is represented by 0 degrees. The horizontal axis on the bottom represents photometric intensity of the vertical light distribution from the aviation obstruction light assembly in units of effective candela. Curve 15 represents a typical photometric intensity distribution from the aviation obstruction light assembly.

Point 9 on the photometric intensity distribution represents intensity in the horizontal direction. The typical specification for aviation medium intensity daylight flashing obstruction light is between 15,000 and 25,000 effective candela (ecd).

Point 10 on the photometric intensity distribution represents the peak intensity which is biased at a positive angle above the horizontal to provide greater visibility to a pilot on approach to the obstruction at a typical angle of approach for landing 16 between 3 and 6 degrees above the horizontal.

Point 11 on the photometric intensity distribution represents intensity at −1 degree below the horizontal. The typical specification for aviation medium intensity daylight flashing obstruction light at −1 degree below the horizontal is between 7,500 and 11,250 effective candela (ecd).

Point 12 on the photometric intensity distribution represents intensity at −10 degrees below the horizontal. The typical specification for aviation medium intensity daylight flashing obstruction light at −10 degrees below the horizontal is less than 3 percent of the peak intensity.

Points 14A and 14B on the photometric intensity distribution represent secondary peak intensity outside of the field of angular specification that are a property of the diffraction of light from the edges of the light distribution modifier in FIG. 3.

The beam spread of the photometric intensity distribution is represented by the angular range 13. The typical specification for aviation medium intensity daylight flashing obstruction light beam spread is greater than 3 degrees at half minimum intensity specification, 7,500 ecd.

Figure 5:
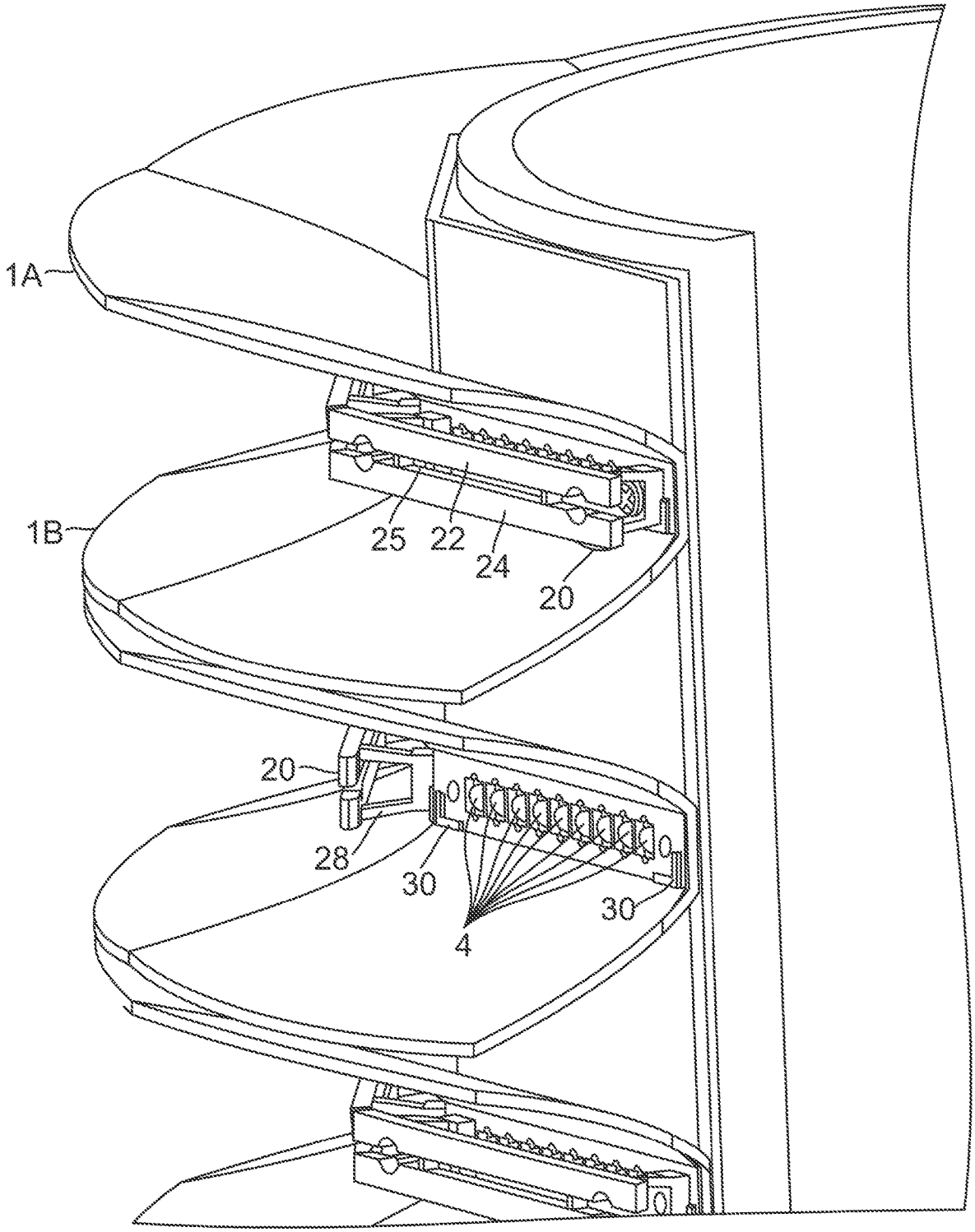
FIG. 5 illustrates a light distribution modifier 20 according to an alternative embodiment of the present invention.

FIG. 5 illustrates a light distribution modifier 20 according to an alternative embodiment of the present invention. Light distribution modifier 20 comprises an upper portion 22, a lower portion 24 and mounting piece 28. The space or hole 25 between the upper portion 22 and the lower portion 24 allows a certain percentage of the light emitted by the array of LEDs 4 to be emitted in the normal direction. Each of the two openings on each side of the opening 25 is where a screwdriver can pass though light distribution modifier 5, so that light distribution modifier 5 can be attached to the PCB 3 via screws.

As illustrated in FIG. 5, the mounting piece 28 comprises two sections, where each section comprises an upper arm, a lower arm and a back piece. The upper arm connects the back piece to the upper portion 22 of light distribution modifier 20 while the lower arm connects the back piece to the lower portion 24 of the light distribution modifier 20. One section is connected at each end of the shield 20. The back piece is connectable to the PCB 3 via screws. Each section of the back piece of light distribution modifier 20 fits inside each of the L-shaped pieces shown in FIG. 5, so as to help with alignment and position of the light distribution modifier 20 inside the luminaire.

Although the light distribution modifier 5 and 20 preferably comprises non-reflective surfaces, light distribution modifier can have alternative designs, such as reflective flat or curved surfaces for the external surface facing toward the LED or array of LEDS. The surface facing away from the LEDs can still be a non-reflective surface. Reflective surfaces can be made any material known to those skilled in the art. The intensity of the light pattern can be enhanced by the design of the reflective surface of light distribution modifier.

Although the position of the shield (i.e., the end piece or backstop) of light distribution modifier 5 and 20 is preferably perpendicular to the optical axis 7, designs of the light distribution modifier can be made where the position of the shield is something other than perpendicular to the optical axis 7. Such a design may be used to direct light toward either or both of the reflector modules 1A or 1B or in some other direction.

A particular configuration of the light distribution modifier 5 is based on specifications and requirements of a particular aviation obstruction light. This means that the required intensities of light in particular directions as detailed in a particular specification will drive the specific design of a light distribution modifier, including for example (1) where the light distribution modifier is positioned in the reflector module which is dependent on the number of LEDS and the positioning of other parts of the reflector module; (2) specific lengths, heights and widths, and various angles between the pieces that comprise the light distribution modifier; and (3) the durability and stiffness of particular pieces of the light distribution modifier.

An example of the intended use of the invention is an aviation obstruction light producing high intensity visible light over a narrow beam spread in the field of view of the pilot of an approaching aircraft while at the same time producing negligible ground scatter low light intensity below the horizontal to minimize residential annoyance.

In an alternative embodiment, the reflector module is inverted such that the upper and lower reflectors in combination with the light distribution modifier project a structure light distribution with a peak intensity below the optomechanical axis of the light assembly and light distribution that is biased in the negative vertical direction with a sharp intensity cut off above the optical axis. An example of the intended use of this alternative embodiment would be a flood light in aviation application for illuminating a landing zone or ground terminal area of an airport or heliport for pilot and airport personnel without creating light noise to pilots on approach to the airport. Another example of the intended use of this alternative embodiment would be a flood light in a commercial application for illuminating a storage area of a port or industrial park or a parking lot.

What is claimed is:

1. A luminaire system comprising:

at least one light source;

a reflector module; and a light distribution modifier, coupled to the reflector module, that is capable of producing a structured light distribution of the at least one light source with a peak intensity above an optical axis and a sharp cut off in intensity below the optical axis and is capable of diffracting part of the light from the at least one light source upward contributing to a light pattern in a far field that has the peak intensity above the optical axis and the sharp cut off below the optical axis, and redirects the light pattern of radiation output in a positive vertical direction.

2. The luminaire system of claim 1, wherein the reflector module comprises an upper off-axis aspheric mirror and a lower off-axis aspheric mirror.

3. The luminaire system of claim 1, wherein the reflector module comprises an upper on-axis aspheric mirror and a lower off-axis tilted aspheric mirror.

4. The luminaire system of claim 1, wherein the light distribution modifier selectively blocks an arc of light from the at least one light source such that the intensity distribution is characterized by an asymmetric distribution of intensity above and below the optical axis with a positive bias in the direction above the optical axis.

5. The luminaire system of claim 1, wherein the at least one light source is an array of light emitting diodes (LEDs).

6. The luminaire system of claim 5, wherein the LEDs are one color or a mixture of visible colors.

7. The luminaire system of claim 5, wherein the LEDs may be one of visible colors, infrared, ultraviolet emitters and a mixture thereof of different wavelength LEDs.

8. The luminaire system of claim 1, wherein the light distribution modifier is opaque to block part of the light distribution from the at least one light source.

9. The luminaire system of claim 1, wherein a part of the light distribution modifier is opaque to block part of the light distribution from the at least one light source;

wherein the reflector module comprises an upper reflector and a lower reflector; and wherein a lower surface of the light distribution modifier is reflective to redirect light from the at least one light source to the upper reflector or the lower reflector so projected light is biased to a positive vertical direction on a plus side of the optical axis.

10. The luminaire system of claim 1, wherein the light distribution modifier is capable of refracting part of the light distribution from the at least one light source upward contributing to a light pattern in the far field that has a peak above the optical axis and a sharp cut off below the optical axis; and wherein the light distribution modifier includes a wedge prism, an array of prisms or a microprism array, a positive or a negative refractive lens optics off-axis or tilted, or other refractive optic to redirect a light pattern of radiation output of the refractive light distribution modifier in a positive vertical direction.

11. The luminaire system of claim 1, wherein the reflector module comprises an upper reflector and a lower reflector; and wherein the light distribution modifier redirects part of the light pattern of radiation from the at least one light source toward the lower reflector surface or the upper reflector surface of the reflector module using a mesoscopic array structure or a nanoscopic array structure contributing to a light pattern in the far field that has the peak intensity above the optical axis and the sharp cut off below the optical axis.

12. The luminaire system of claim 1, wherein the reflector module comprises an upper reflector and a lower reflector; and wherein the light distribution modifier reflects part of the light pattern of radiation from the at least one light source toward the lower reflector surface or the upper reflector surface of the reflector module contributing to a light pattern in the far field that has the peak intensity above the optical axis and the sharp cut off below the optical axis.

13. The luminaire system of claim 1, wherein the reflector module is molded and wherein the light distribution modifier is molded, machined, created using a three-dimensional printer or by additive manufacturing.

14. The luminaire system of claim 1, further comprising:

a hub assembly;

a heat sink;

at least one printed circuit board coupled to the hub assembly or the heat sink and to the at least one light source.

15. The luminaire system of claim 14, wherein the optical axis of the at least one light source and the light distribution modifier are normal to the surface of the hub assembly.

16. The luminaire system of claim 1, wherein the reflector module comprises an upper reflector and a lower reflector; and wherein the reflector module is inverted such that the upper and lower reflectors are capable of producing a structured light distribution with peak intensity below the optical axis with a sharp cut off in intensity above the optical axis.

17. A luminaire light system comprising: a plurality of reflector modules;

a plurality of light distribution modifiers having an upper portion connected to a corresponding one of the reflector modules and a lower portion connected to the corresponding one of the reflector modules, each a first part of the upper portion and the lower portion extending a distance from the corresponding one of the reflector modules, the light distribution modifiers capable of producing a light distribution with peak intensity above an optical axis and a sharp cut off in intensity below the optical axis;

one or more light sources;

at least one arm that extends a distance from the one or more light sources; and a shield coupled to the at least one arm and being positioned in a direction perpendicular to the optical axis.

18. The luminaire light system of claim 17, wherein the one or more light sources is an array of LEDs (light emitting diodes) having at least one color.

19. The luminaire light system of claim 17, wherein a corresponding one of the one or more light sources, a corresponding one of the reflector modules and a corresponding one of the light distribution modifiers are affixed in different directions to project a directional light distribution in a horizontal generating a directional arc of light or an omni-directional beam of light over 360 degrees horizontal.

* * * * *